US005685923A

United States Patent [19]

Takata et al.

[11] Patent Number: 5,685,923

[45] Date of Patent: Nov. 11, 1997

[54] FERRITIC STAINLESS STEEL BELLOWS

[75] Inventors: Ken Takata; Akio Yamamoto, both of Futtsu, Japan

[73] Assignee: Nippon Steel Corporation, Tokyo, Japan

[21] Appl. No.: 579,187

[22] Filed: Dec. 27, 1995

[30] Foreign Application Priority Data

Dec. 28, 1994 [JP] Japan ..... 6-328752

[51] Int. Cl.[6] ..... C22C 38/06; C22C 38/18

[52] U.S. Cl. ..... 148/325

[58] Field of Search ..... 420/34, 70; 148/325

[56] References Cited

U.S. PATENT DOCUMENTS

| | | | |
|---|---|---|---|
| 4,286,986 | 9/1981 | Borneman et al. | 148/325 |
| 4,461,811 | 7/1984 | Borneman et al. | 420/68 |
| 4,690,798 | 9/1987 | Narutani et al. | 420/61 |

FOREIGN PATENT DOCUMENTS 49-107915 10/1974 Japan .

*Primary Examiner*—Deborah Yee
*Attorney, Agent, or Firm*—Kenyo & Kenyon

[57] ABSTRACT

Disclosed is a ferritic stainless steel for forming into bellows having high resistance to stress corrosion cracking, comprising, in terms of wt %, not greater than 0.02% of C, from 0.1 to 1.5% of Si, not greater than 1.0% of Mn, from 11.0 to 22.0% of Cr, from 0.01 to 0.08% of Al, not greater than 0.015% of N, at least one of not greater than 0.6% of Ti and not greater than 1.0% of Nb, whenever necessary, and furthermore, at least one of not greater than 2% of Mn, not greater than 1.5% of Cu and not greater than 1.5% of Ni. This steel has the crystal grain size measured in a section in a direction orthogonal to a rolling direction is not greater than 8.5 in terms of the grain size number, and the crystal grain size measured in a section orthogonal to a section parallel to the rolling direction is not smaller than 5.0 on an average in terms of the grain size number.

6 Claims, No Drawings

FERRITIC STAINLESS STEEL BELLOWS

BACKGROUND OF THE INVENTION

1. Field of the Invention

The present invention relates to a ferritic stainless steel for forming into bellows.

In comparison with bellows made of an austenitic stainless steel, bellows made of a ferritic stainless steel have the characterizing features that stress resistance and corrosion crack resistance are extremely excellent. However, forming into the bellows is extremely difficult, and breakage frequently occurs during forming. The present invention relates to a ferritic stainless steel for forming into bellows, capable of reducing the amount of breakage which is likely to occur during forming.

2. Description of the Prior Art

In various machines and apparatuses handling gasses, solutions and powders, the materials are mostly transferred through metal pipings. Bellows are used at intermediate portions in such metal pipings so as to absorb the strain resulting from thermal expansion and vibration, and to prevent transmission of the strain and the vibration. Conventionally, copper, an austenitic stainless steel, etc., have been used for the bellows because forming other metals into a bellows structure has been difficult. In other words, copper and the austenitic stainless steel have large elongation while cold and are the most optimum materials for the bellows to which bulge processing, formed by elongation, is particularly applied. In contrast, those metals which comprise bcc crystals such as carbon steel cannot be processed by bulging because the ductility of the metals, particularly the ductility at a weld portion, is not sufficient.

On the other hand, though the bellows made of the austenitic stainless steel can be easily produced, they involve the problem that stress corrosion cracks are likely to occur due to corrosive solutions passing through the bellows. The bellows absorb the stress and the vibration by bending at the protruding peak portions and the recessed valley portions thereof and for this reason, the stress always acts on the protruding portions and the recessed portions. In other words, the bellows have a structure or a component from which the stress can never be removed. Nonetheless, austenitic stainless steel is an alloy having high stress corrosion cracking susceptibility. Accordingly, bellows made of the austenitic stainless steel involve a problem that stress corrosion cracking is extremely likely to occur.

To avoid stress corrosion cracking, there are only two methods, that is, either a material having low stress corrosion crack susceptibility is used or a structure in which stress corrosion crack cannot easily occur, that is, a structure that does not leave a stress load, is employed. To reduce stress corrosion crack susceptibility of the austenitic stainless steel, Japanese Unexamined Patent Publication (Kokai) No. 49-107915, for example, proposes to reduce the Cr, N, Mo and P content by increasing the Ni content. Even when such a steel is employed, however, only the time before the occurrence of stress corrosion crack is prolonged to a certain extent, but the occurrence of stress corrosion cracking cannot be prevented.

On the other hand, it would be conceivable to reduce the stress acting on the recessed portions or on the protrusive portions by increasing the number of concavo-convexities or by reducing the bending angle of the recessed portions or the protrusive portions so as to disperse the stress. According to this method, however, the bellows become elongated or large, so that the apparatus must be greater in size and the cost of production becomes higher. Nonetheless, the problem of susceptibility to stress corrosion cracking cannot be solved, and the problem of stress corrosion cracking has remained unsolved depending on environments.

In contrast, the present inventors have succeeded in producing bellows which practically eliminate stress corrosion cracking susceptibility by limiting ductility of the ferritic stainless steel.

SUMMARY OF THE INVENTION

Although the present inventors have thus succeeded in machining the ferritic stainless steel into the bellows, breakage, which as results from an insufficiency of ductility of the material, occurs many times during forming particularly at the peak portions of the bellows and at the end portions of the formed portion, and the yield has been much lower than that from machining austenitic stainless steel. Therefore, the present inventors have conducted experiments so as to improve the ductility of the raw material by reducing the C and N contents to the minimum contents on the basis of a known concept. Although ductility of the raw material, by the tensile test, has been improved, breakage at the peak portions of the bellows and at the end portions of the formed portion have not necessarily been reduced.

Accordingly, when the fracture is inspected, Al and O are detected at a part of the fracture, and it has thus been found out that aluminum oxides are associated with the breakage. It has been deduced from this fact that the breakage starts from inclusions and develops into ductile breakage. It has been recognized in the past that when the workpiece is bent, particularly parallel to a rolling direction, sulfide type inclusions which extend along the rolling direction function as the starting point of the breakage due to bending, and spherical alumina type inclusions were believed harmless unless they were particularly coarse. According to the tensile test, further, ductility is not lowered unless the alumina type inclusions are particularly coarse.

If the alumina type inclusions are the cause of the breakage, counter-measures can be taken by reducing the Al content. Therefore, when the amount of addition of Al is reduced to 0.005% or below in terms of acid-soluble Al, deoxidation becomes incomplete and large quantities of Si type inclusions occur, though the Al type inclusions can be eliminated. Though forming of this material into the bellows has not been done, it is believed to be unavoidable, according to the past experience, that machining cracks develop. In other words, when Al is added, the alumina type inclusions occur and when the Al content is reduced, deoxidation becomes incomplete and large quantities of the Si type inclusions occur. In either case, cracks resulting from the inclusions cannot be prevented.

As described above, the present inventors have encountered with phenomena which are different from the impediments to the conventional bellows processing, and the conventional concept cannot cope with such impediments.

Accordingly, the present invention contemplates prevention of machining cracking due to the inclusions different from the conventional concept, and to improve the yield and productivity of the ferritic stainless steel in the bellows.

DESCRIPTION OF THE PREFERRED EMBODIMENTS

The present inventors have conducted various analyses of the conditions of the occurrence of breakage during forming of ferritic stainless steel into bellows, and have found out that the degree of occurrence of cracking is relatively mild in materials whose final annealing temperature is high. It is believed that the strength of the material is lowered and its ductility can be improved if the final annealing temperature is high, and a high final annealing temperature may be qualitatively advantageous for reducing the cracking during forming. However, when the mechanical characteristics of the materials are examined by the tensile test, the level of the reduction of the strength and the level of the improvement in ductility are not always significant.

On the other hand, the portions of the occurrence of breakage at the time of forming the ferritic stainless steel into the bellows have been examined in detail. As a result, it has been found out that when the alumina type inclusions exist in the grain boundary, they are extremely likely to become the starting point of breakage. When this fact is taken into consideration in combination with the fact described above, that the occurrence of crack becomes less when the final annealing temperature of the material is higher, it is assumed that the higher the final annealing temperature, the coarser becomes the crystal grain and, eventually, the quantity of the alumina inclusions existing in the grain boundary decrease, so that the occurrence ratio of breakage occurring during forming into the bellows is reduced.

The reason why the inclusions existing in the grain boundary exert great influence on breakage occurring during forming into the bellows has not been clarified. However, because forming into the bellows is not a deformation in one direction such as a tensile test or bending but is two-dimensional process which also involves deformation in a planar direction, the difference of this deformation mode would presumably exert an influence.

From the result described above, it is estimated that when any inclusions other than the alumina type inclusions exist in the grain boundary, breakage is more likely to occur during forming of the bellows. Accordingly, to prevent the occurrence of breakage, it is very important to reduce, as much as possible, the inclusions and, at the same time, to reduce the area of the grain boundary.

According to the prior concept, inclusions extending in the rolling direction are detrimental to elongation (bending) in a direction at right angles to the inclusions. When deoxidation of the steel is not sufficient, Si type stretched inclusions are generated. Therefore, it is important to reliably carry out deoxidation and to this end, the addition of Al is indispensable.

The technical concept of the present invention is directed to preventing cracks occurring during forming into the bellows by reducing the probability of the existence of the inclusions in the grain boundary by increasing the crystal grain size on the basis of the concept described above. A bulging which is used for forming into the bellows imparts two-dimensional deformation to the raw material, but in forming of the steel pipe into the bellows, deformation in a direction orthogonal to the rolling direction is particularly great. On the other hand, because the ferritic stainless steels generally have the crystal grains stretched in the rolling direction, the probability of the existence of the inclusions in the crystal grain which is substantially parallel to the rolling direction is believed particularly great. Accordingly, the present invention does not merely reduce the probability of the existence of the inclusions in the grain boundary by increasing the crystal grain size, but is mainly directed to reduce the crystal grain boundary which is parallel to the rolling direction.

When various examinations are conducted on the basis of the technical concept described above, cracks occurring during forming into the bellows can be drastically reduced by limiting the crystal grain size, which is measured in the section in a direction orthogonal to the rolling direction, to 8.5 or below, preferably not greater than 8.0 and most preferably not greater than 7.5, in terms of the grain size number. The grain size number is defined under the ASTM standard.

The method of controlling the grain size measured in the section orthogonal to the rolling direction and the grain size measured in the section parallel to the rolling direction can be practiced by expanding and combining the conventional concepts.

Recrystallization of the cold rolled materials occurs in such a manner that the crystal grains before cold rolling are stretched in the rolling direction by cold rolling and the crystal grains so stretched are then cut by subsequent annealing and are allowed to undergo divided recrystallization. If the crystal grain is great before cold rolling or the reduction is small, in this instance, the crystal grain size measured in the section orthogonal to the rolling direction becomes great.

When the starting point of recrystallization is reduced by lowering the annealing temperature, the crystal grain size measured in the section parallel to the rolling direction becomes great. When the annealing temperature becomes even lower, the crystal grains do not undergo recrystallization but are merely softened. In this case, the crystal grains are not different from the crystal grains as rolled in the rolling direction and as cold rolled.

Accordingly, it becomes possible to control the crystal grain size measured in the section orthogonal to the rolling direction by selecting a suitable reduction ratio in accordance with the crystal grain size before cold rolling, and to control the crystal grain size measured in the section parallel to the rolling direction by setting the annealing temperature to a suitable temperature.

In other words, the grain size measured in the section orthogonal to the rolling direction and the grain size measured in the section parallel to the rolling direction can be suitably controlled by suitably selecting the crystal grain size before cold rolling, the cold rolling reduction ratio and the annealing temperature.

The present invention has been completed on the basis of the technical concept described above. Firstly, the present invention provides:

a ferritic stainless steel for forming into bellows comprising, in terms of wt %:
C: not greater than 0.02%
Cr: 11.0 to 22.0%,
Al: 0.01 to 0.08%,
N: not greater than 0.015%, wherein the crystal grain size measured in a section in a direction orthogonal to a rolling direction is not greater than 8.5 in terms of the grain size number, and the crystal grain size measured in a section orthogonal to a section parallel to the rolling direction is not smaller than 5.0 on an average in terms of the grain size number.

When the temperature of use of the bellows is within the range of 600° to 900° C., carbonitrides of Cr that have been precipitated in the raw material at normal temperature again undergo solid solution, to again precipitate at the grain boundary, become further coarser, lower the strength of the raw material and serve as the starting points of fatigue and corrosion fatigue. This reprecipitation can be eliminated by fixing the Cr carbonitrides to those carbides or nitrides which do not undergo solid solution within this temperature range, at the stage of the raw material during the production. Therefore, the present inventors have attempted to convert C and N to Ti and Nb carbonitrides which are stable at high temperature, by adding Ti and Nb.

When the temperature is within such a high range, various salts existing in the atmosphere, such as in an exhaust system of automobiles, adhere and are fused to generate molten salt corrosion. In this case, so-called "molten salt corrosion resistance" is required in addition to oxidation resistance. It has been found out that the addition of a suitable amount of Si to form a stable Si oxide film is effective for preventing this molten salt corrosion.

Secondary, the present inventors have completed the second concept as one of the embodiments directed to use in an environment of 600° to 900° C. such as in the exhaust system of automobiles. The invention provides:

a ferritic stainless steel for forming into bellows comprising, in terms of wt %:
C: not greater than 0.02%,
Si: from 0.1 to 1.5%,
Mn: not greater than 1.0%,
Cr: from 11.0% to 22.0%,
Al: from 0.01 to 0.08%,
N: not greater than 0.015%, at least one of the following components:
Ti: at least four times the sum of the C and N contents and not greater than 0.6%, and
Nb: at least eight times the sum of the C and N contents and not greater than 1.0%, and other unavoidable impurities and Fe, wherein the crystal grain size measured in a section in a direction orthogonal to a rolling direction is not greater than 8.5 in terms of the grain size number, and the crystal grain size measured in a section parallel to the rolling direction is not smaller than 5.0 on an average in terms of the grain size number.

Thirdly, the bellows are often used as a component for apparatuses handling chemicals. In this case, heretofore known chemical resistance improving elements can be added so as to satisfy the requirement for the corrosion resistance. The third and fourth inventions are completed as an embodiment for the application for which a high corrosion resistance is required, in line with the concept described above. The present invention further provides:

a ferritic stainless steel for forming into bellows comprising; in terms of wt %,
C: not greater than 0.02%,
Cr: from 11.0 to 22.0%,
Al: from 0.01 to 0.08%,
N: not greater than 0.015%, at least one of the following components,
Mo: not greater than 2%,
Cu: not greater than 1.5%, and
Ni: not greater than 1.5%, wherein the crystal grain size measured in a section in a direction orthogonal to a rolling direction is not greater than 8.5 in terms of the grain size number, and the crystal grain size measured in a section orthogonal to a section parallel to the rolling direction is not smaller than 5.0 on an average in terms of the grain size number.

Fourthly, the present invention provides; a ferritic stainless steel for forming bellows comprising, in terms of wt %,
C: not greater than 0.02%,
Si: from 0.1 to 1.5%,
Mn: not greater than 1.0%,
Cr: from 11.0 to 22.0%,
Al: from 0.01 to 0.08%, at least one of the following components,
Ti: at least four times the sum of the C and N contents and not greater than 0.6%, and
Nb: at least eight times the sum of the C and N contents and not greater than 1.0%, at least one of the following components,
Mo: not greater than 2%,
Cu: not greater than 1.5%,
Ni: not greater than 1.5%, and other unavoidable impurities and Fe, wherein the crystal grain size measured in a section in a direction orthogonal to a rolling direction is not greater than 8.5 in terms of the grain size number, and the crystal grain size measured in a section orthogonal to a section parallel to the rolling direction is not smaller than 5.0 on an average in terms of the grain size number.

Next, the limiting conditions in the present invention will be explained.

The ferritic stainless steel for the bellows is limited to those ferritic stainless steels in which C is limited to not greater than 0.02% and N, to not greater than 0.015%.

The ferritic stainless steel has far higher resistance to stress corrosion cracking than the austenitic stainless steel, irrespective of its Cr content, in a bellows. However, if the Cr content is less than 11%, the basic corrosion resistance becomes extremely low, and if it is added in a large amount, the machinability deteriorates. Therefore, the upper limit is set to 22.0%.

If the C content of the raw material exceeds 0.02%, forming of the steel into the bellows becomes difficult and even if forming can be done, the fatigue characteristics deteriorate due to the Cr carbides precipitating in the raw material. For this reason, the upper limit is set to 0.02%.

If the N content in the raw material exceeds 0.015%, forming into the bellows becomes difficult in the same way as in the case of C and even if forming can be done, the fatigue characteristics deteriorate due to the Cr nitrides precipitating in the raw material. Therefore, the upper limit is set to 0.015%.

Aluminum (Al) is the element necessary for deoxidation. Since deoxidation must be reliably effected, the lower limit is set to 0.01%. If Al is added in a large amount, the viscosity of a solution becomes high, floating of alumina type inclusions as the deoxidation product is limited and the inclusions are likely to remain as such. Moreover, ductility of the raw material is lowered. For these reasons, the upper limit is set to 0.08%.

To reduce the crystal grain boundary, particularly the grain interface substantially parallel to the rolling direction, the crystal grain size measured in the section in an orthogonal direction to the rolling direction is limited to not greater than 8.5, preferably not greater than 8.0 and further preferably not greater than 7.5, in terms of the grain size number, and in this way, cracks that occur during forming of the steel into the bellows can be drastically reduced. Therefore, the upper limit is set to 8.0. However, if the grain size is too great, the concavoconvexities occurring in processing become great and the fatigue characteristics during use deteriorate. Therefore, the lower limit is set to not smaller than 5.0 on an average as the grain size number measured in the section (C section) orthogonal to the section (L section) parallel to the rolling direction.

In the second invention, as an embodiment directed to the use in an environment of 600° to 900° C. such as in an exhaust system of automobiles, the addition of Si constitutes a characterizing feature.

To secure the molten salt corrosion resistance, a stable oxide film of Si must be formed within a temperature range of 600° to 900° C. and to this purpose, at least 0.1% of Si must be added. However, if Si is added in a large amount, forming of the steel into bellows becomes extremely difficult, and even if the forming can be done, the difference between the protrusive portions and the recessed portions becomes so small that the structure must be extremely elongated in order to secure the bellows functions. Therefore, the upper limit is set to 1.5%.

Although Mn is necessary to secure machinability of the raw material when forming it into the bellows, the upper limit of Mn is set to 1.0% because Si is added to secure the resistance to molten salt corrosion.

The third invention, which is completed as the embodiment not requiring a severe limitation on welding methods and devoid of degradation of the fatigue characteristics and the corrosion fatigue characteristics due to coarsening of the precipitates during the use, is characterized in that Ti and Nb are added.

When Ti undergoes solid solution at the time of welding, it fixes the major proportions of C and N, and its equivalent is at least the four times the sum of the C and N contents. Therefore, this value is set as the lower limit. When Ti is added in a large amount, however, it absorbs N and forms the nitride at the time of welding, and a limitation on the welding method becomes necessary again. Therefore, the upper limit is set to 0.6%.

When Nb undergoes solid solution at the time of welding, it fixes the major proportions of C and N, and its equivalent is at least eight times the sum of the C and N contents. Therefore, this value is set as the lower limit. When Nb is added in a large amount, however, it absorbs N and forms the nitride at the time of welding, and a limitation on the welding method becomes necessary again. Therefore, the upper limit is set to 1.0%.

The fourth invention, as embodiments directed to an application for which high corrosion resistance is required, are characterized in that at least one of Mo, Cu and Ni is added.

Mo is particularly effective for the chlorine ion but when it is added in an amount exceeding 2%, machinability drops and machining into bellows becomes difficult.

Cu improves the corrosion resistance particularly in a low pH environment containing sulfuric acid, but when it is added in an amount exceeding 1.5%, Cu which is not converted to the solid solution, precipitates in the grain boundary of the weld portion and forming into the bellows becomes difficult. Therefore, this value is set as the upper limit.

Ni improves the corrosion resistance in a low pH environment, but when it is added in an amount exceeding 1.5%, a martensite phase occurs at the weld portion and forming into bellows becomes difficult. Therefore, this value is set as the upper limit.

The ferritic stainless steel as the base metal can sufficiently secure the difference of the diameters between the protruding portions and the recessed portions of the bellows by limiting the C and N contents to low levels.

Deoxidation is reliably carried out by limiting Al to reduce the inclusions, and at the same time, the inclusions which exist in the grain boundary and become the cause of the breakage occurring during forming of the ferritic stainless steel into the bellows are reduced by limiting the area of the grain boundary parallel to the rolling direction which is particularly detrimental. As a result, the grain boundary which opens due to two-dimensional deformation and has a low strength can be reduced and, eventually, breakage during forming of the bellows can be reduced.

Because a suitable amount of Ti is added to the base metal, precipitation of the Cr carbides at the weld portion and the heat affected portions can be eliminated, and the occurrence of grain boundary corrosion and deterioration of the full face corrosion resistance can also be eliminated. Accordingly, measures for minimizing the fused portions and the heat affected portions by limiting the welding method becomes unnecessary, so that severe limitations on the welding method are not necessary.

Further, because a suitable amount of Ti is added, the carbonitrides of Cr in the raw material which precipitate in an environment of 600° to 900° C. again undergo solid solution and consequently, a drop in the strength of the raw material and a deterioration of the fatigue characteristics resulting from re-precipitation of the Cr carbonitrides to the grain boundary can be eliminated. Because a suitable amount of Si is added and the Cr content is limited, a stable Si oxide film can be formed in addition to the oxide film consisting principally of Cr. Therefore, the oxidation resistance can be improved and the so-called molten salt corrosion resistance, to molten salt corrosion occurring due to adhesion and melting of various salts existing in the environment, can be improved. As a result, forming of the ferritic stainless steel into the bellows having excellent high temperature characteristics of 600° to 900° C., such as in the exhaust system of automobiles, can be done.

As described above, the present invention can drastically improve the production yield of bellows from the economical ferritic stainless steel without containing expensive Ni and having excellent stress corrosion crack resistance. Conventionally, although the ferritic stainless steel has been formative into the bellows, breakage has occurred more frequently during forming than in the austenitic stainless steel, and the production cost has been higher. However, the present invention can drastically improve the production yield, and the advantage that it does not contain Ni reduces the production cost.

The steel according to the present invention makes it possible to produce the bellows sufficiently satisfactory in both high temperature fatigue and molten salt corrosion, in addition to stress corrosion cracking, even when used in a high temperature environment of 600° to 900° C. such as in an exhaust system of automobiles.

As a result, maintenance of apparatuses using the bellows can be extremely simplified, and service life of the apparatuses can be extended as a whole. Because maintenance can be thus simplified, productivity can be improved. Therefore, the present invention provides great industrial advantages.

EXAMPLE

Example 1

Electric welded steel pipes having an outer diameter of 55 mmϕ were produced by using 0.7 mm-thick cold rolled sheets (annealed materials) of the steels tabulated in Table 1. In this instance, the crystal grain of each cold rolled annealed material was controlled by limiting a cold rolling reduction ratio and an annealing temperature after cold rolling. A production test of bellows having a peak pitch of 15 mm, three peak heights of 10, 11 and 12 mm, a total number of peak of 18 and a full length of about 250 mm was carried out by hydraulic bulging from each of the weld pipes. Table 2 shows the relationship between the result and each grain size of the raw material.

TABLE 1

| steel | chemical composition C | Si | Mn | Cr | Ni | Ti | Nb | Mo | Cu | Al | N | Remarks |
|---|---|---|---|---|---|---|---|---|---|---|---|---|
| A | 0.007 | 0.26 | 0.11 | 16.3 | — | — | — | — | — | 0.021 | 0.0060 | steel within the range of the invention |
| B | 0.006 | 1.26 | 0.14 | 16.4 | — | 0.16 | — | — | — | 0.027 | 0.0053 | steel within the range of the invention |
| C | 0.011 | 0.85 | 0.66 | 13.8 | — | 0.14 | 0.22 | — | — | 0.014 | 0.0073 | steel within the range of the invention |
| D | 0.006 | 0.23 | 0.11 | 12.6 | 0.35 | 0.10 | — | — | — | 0.016 | 0.0049 | steel within the range of the invention |
| E | 0.008 | 0.33 | 0.15 | 17.1 | — | 0.18 | — | 1.30 | — | 0.018 | 0.0074 | steel within the range of the invention |
| F | 0.010 | 0.48 | 0.18 | 19.2 | 0.26 | — | 0.35 | — | 0.42 | 0.013 | 0.0096 | steel within the range of the invention |
| G | 0.035 | 0.45 | 0.48 | 16.2 | — | — | — | — | — | 0.108 | 0.0113 | comparative steel |
| H | 0.009 | 0.32 | 0.88 | 13.5 | — | 0.18 | 0.26 | — | — | 0.045 | 0.0181 | comparative steel |
| I | 0.009 | 0.34 | 0.15 | 16.1 | — | — | — | — | — | 0.001 | 0.0133 | comparative steel |

TABLE 2

| No | steel | C section grain size | L section grain size | means grain size | existence of machining cracks 10 mm | 11 mm | 12 mm |
|---|---|---|---|---|---|---|---|
| 1 | A | 7.3 | 6.3 | 6.8 | o | o | o |
| 2 | B | 8.3 | 7.8 | 8.1 | o | x | x |
| 3 | B | 7.4 | 6.0 | 6.7 | o | o | o |
| 4 | B | 5.7 | 5.0 | 5.4 | o | o | o |
| 5 | C | 7.7 | 7.5 | 7.6 | o | o | o |
| 6 | D | 8.1 | 7.0 | 7.6 | o | o | o |
| 7 | E | 8.7 | 7.5 | 8.1 | o | o | x |
| 8 | E | 7.2 | 6.2 | 6.7 | o | o | o |
| 9 | F | 7.8 | 7.2 | 7.5 | o | o | o |
| 10 | B | 9.0 | 7.9 | 8.5 | x | x | x |
| 11 | E | 9.3 | 8.5 | 8.9 | x | x | x |
| 12 | G | 7.7 | 6.9 | 7.3 | x | x | x |
| 13 | H | 8.2 | 7.7 | 8.0 | x | x | x |
| 14 | I | 7.7 | 6.7 | 7.2 | x | x | x |

*raw material: thickness 0.7 mm, outer diameter of pipe 55 mmϕ
*target machining shape: bellows having peak pitch of 15 mm, 18 peaks and full length of about 250 mm
*peak height: 10, 11 and 12 mm (corresponding to figures in "machining cracks")

Cracks did not at all occur in the steels Nos. 1 to 9 of the steels of the present invention when they were formed into bellows having a peak height of 10 mm. When the peak height was 11 mm, however, cracks occurred in the steel No. 2 where the grain size measured in a section orthogonal to the rolling direction and in the steel No. 7 where the mountain height was 12 mm. On the other hand, cracks occurred in the steels Nos. 10 and 11 where the crystal grain size measured in a section (C section) in a direction orthogonal to the rolling direction was great (the crystal size was small). Oxides which were assumed to be Al oxides were detected in the vicinity of the portions assumed to be the starting point, from the observation of the fracture.

Cracks also occurred, during forming into bellows, in the steel No. 12 (steel No. G) having a lager amount of addition of Al. Considerably coarse Al type inclusions were also detected in the portions which were assumed to be the starting point of the fracture. The steel No. 13 (steel No. H), having a high N content, had a high strength but low ductility, so that cracks occurred. Cracks occurred during forming into the bellows in the steel No. 14 (steel No. I) having a small amount of addition of Al. Observation of the fracture revealed large quantities of Si oxide type inclusions, and breakage was assumed to occur with these inclusions as the starting points.

We claim:

1. Bellows made of a ferritic stainless steel consisting essentially of, in terms of wt %:

C: not greater than 0.02%,

Cr: from 11.0 to 22.0%,

Al: from 0.01 to 0.08%,

N: not greater than 0.015%, and balance Fe and unavoidable impurities, wherein the crystal grain size measured in a section in a direction orthogonal to a rolling direction is not greater than 8.5 in terms of the grain size number, and the crystal grain size measured in a section orthogonal to a section parallel to the rolling direction is not smaller than 5.0, on average, in terms of the grain size number.

2. Bellows made of a ferritic stainless steel consisting essentially of, in terms of wt %:

C: not greater than 0.02%,

Si: from 0.1 to 1.5%,

Mn: not greater than 1.0%,

Cr: from 11.0 to 22.0%,

Al: from 0.01 to 0.08%,

N: not greater than 0.015%, balance Fe and unavoidable impurities, and at least one of the following components:

Ti: at least four times the sum of the C and N contents and not greater than 0.6%, and Nb: at least eight times the sum of the C and N contents and not greater 1.0%, wherein the crystal grain size measured in a section in a direction orthogonal to a rolling direction is not greater than 8.5 in terms of the grain size number, and the crystal grain size measured in a section orthogonal to a section parallel to the rolling direction is not smaller than 5.0, on average, in terms of the grain size number.

3. Bellows made of a ferritic stainless steel consisting essentially of, in terms of wt %:

C: not greater than 0.02%,

Cr: from 11.0 to 22.0%,

Al: from 0.01 to 0.08%, and

N: not greater than 0.015%, balance Fe and unavoidable impurities, and at least one of the following components:

Mo: not greater than 2%,

Cu: not greater than 1.5%, and

Ni: not greater than 1.5%, wherein the crystal grain size measured in a section in a direction orthogonal to a rolling direction is not greater than 8.5 in terms of the grain size number, and the crystal grain size measured in a section orthogonal to a section parallel to the rolling direction is not smaller than 5.0, on average, in terms of the grain size number.

4. Bellows made of a ferritic stainless steel consisting essentially of, in terms of wt %:

C: not greater than 0.02%,

Cr: from 11.0 to 22.0%,

Al: from 0.01 to 0.08%, and

N: not greater than 0.015%, and at least one of the following components:

Ti: at least four times the sum of the C and N contents and not greater than 0.6%, and Nb: at least eight times the sum of the C and N contents and not greater 1.0%, and at least one of the following components:

Mo: not greater than 2%,

Cu: not greater than 1.5%, and

Ni: not greater than 1.5%, and balance Fe and unavoidable impurities, wherein the crystal grain size measured in a section in a direction orthogonal to a rolling direction is not greater than 8.5 in terms of the grain size number, and the crystal grain size measured in a section orthogonal to a section parallel to the rolling direction is not smaller than 5.0, on average, in terms of the grain size number.

5. Bellows made of a ferritic stainless steel according to any of claims 1 through 4, wherein the crystal grain size measured in the section in the direction orthogonal to the rolling direction is not greater than 8.0 in terms of the grain size number, and the crystal grain size measured in the section orthogonal to the section parallel to the rolling direction is not smaller than 5.0, on average, in terms of the grain size number.

6. Bellows made of a ferritic stainless steel according to any of claims 1 through 4, wherein the crystal grain size measured in the section in the direction orthogonal to the rolling direction is not greater than 7.5 in terms of the grain size number, and the crystal grain size measured in the section orthogonal to the section parallel to the rolling direction is not smaller than 5.0, on average, in terms of the grain size number.

* * * * *